US007861701B1

(12) United States Patent
Wei

(10) Patent No.: US 7,861,701 B1
(45) Date of Patent: Jan. 4, 2011

(54) SHOOTING DEVICE FOR AIR GUNS AND PAINTBALL GUNS

(76) Inventor: Wilson Wei, P.O. Box 24-108, Taipei (TW)

( * ) Notice: Subject to any disclaimer, the term of this patent is extended or adjusted under 35 U.S.C. 154(b) by 0 days.

(21) Appl. No.: 11/256,773

(22) Filed: Oct. 25, 2005

(51) Int. Cl.
*F41B 11/00* (2006.01)

(52) U.S. Cl. ..... 124/73

(58) Field of Classification Search ..... 124/73–77
See application file for complete search history.

(56) References Cited

U.S. PATENT DOCUMENTS 5,476,087 A * 12/1995 Kunimoto ..... 124/73
5,711,286 A * 1/1998 Petrosyan et al. ..... 124/73
6,494,194 B2 * 12/2002 Shipachev et al. ..... 124/73
6,810,870 B1 * 11/2004 Hu ..... 127/76

* cited by examiner

*Primary Examiner*—Michael J. Carone
*Assistant Examiner*—Gabriel J. Klein
(74) *Attorney, Agent, or Firm*—Jackson IPG PLLC; Demian K. Jackson

(57) ABSTRACT

An improved shooting device for air guns and paintball guns comprises a gun barrel sheathed into a sliding base of a breech of a gun, a tension spring installed at the front end, a bullet supplying device installed at the rear end, an opener connected to the rear of the bullet supplying device, and a bullet supplying hole formed at the bottom of the bullet supplying device and interconnected with the bullet feeding hole of a handle type magazine. The gun barrel includes an elastic turning base pivotally connected thereon, a pushing groove formed at the rear edge of the turning base, a sliding surface formed at the bottom of the turning base, and the pushing groove and a pushing protrusion disposed at the top of a trigger are engaged, so that when the trigger is pulled, the pushing protrusion at the top of the trigger pushes the pushing groove of the turning base, such that the turning base drives the gun barrel to compress the tension spring and produce a forward displacement. In the meantime, the rear end of the gun barrel moves forward along the bullet supplying device to open the bullet supplying hole, such that the bullets will be supplied automatically from the bullet feeding hole of the cartridge magazine by the pushing force, until the pushing protrusion is separated from the pushing groove, and then the resilience of the tension spring drives the gun barrel to shift backward, and the rear end of the gun barrel will be loaded with a bullet and the bullet feeding hole will be shut, and the opener is pushed to open a valve. The high-pressure gas in a pressurized cylinder forces to shoot the bullet. The invention can reduce the volume of the automatic bullet loading device and avoid the leak of pressurized gas, and further improve the shooting force.

2 Claims, 8 Drawing Sheets

SHOOTING DEVICE FOR AIR GUNS AND PAINTBALL GUNS

BACKGROUND OF THE INVENTION

1. Field of the Invention

The present invention relates to an improved shooting device for air guns and paintball guns, and more particularly to a design for improving the automatic bullet loading device of air guns and paintball guns having a bulky size and an easy leak of pressurized gas during the shooting of the gun, and the gas leak reduces the pushing force of the bullets. The improved shooting device for air guns and paintball guns comprises a gun barrel sheathed into a sliding base of a breech of a gun, a tension spring installed at the front end, a bullet supplying device installed at the rear end, an opener connected to the rear of the bullet supplying device, and a bullet supplying hole formed at the bottom of the bullet supplying device and interconnected with the bullet feeding hole of a handle type magazine. The gun barrel includes an elastic turning base pivotally connected thereon, a pushing groove formed at the rear edge of the turning base, a sliding surface formed at the bottom of the turning base, and the pushing groove and a pushing protrusion disposed at the top of a trigger are engaged, so that when the trigger is pulled, the pushing protrusion at the top of the trigger pushes the pushing groove of the turning base, such that the turning base drives the gun barrel to compress the tension spring and produce a forward displacement. In the meantime, the rear end of the gun barrel moves forward along the bullet supplying device to open the bullet supplying hole, such that the bullets will be supplied automatically from the bullet feeding hole of the cartridge magazine by the pushing force, until the pushing protrusion is separated from the pushing groove, and then the resilience of the tension spring drives the gun barrel to shift backward, and the rear end of the gun barrel will be loaded with a bullet and the bullet feeding hole will be shut, and the opener is pushed to open a valve. The high-pressure gas in a pressurized cylinder forces to shoot the bullet. The invention can reduce the volume of the automatic bullet loading device and avoid the leak of pressurized gas, and can further improve the shooting force.

2. Description of the Related Art

Paintball and air gun shooting has become a popular outdoor activity for training individual shooting, sports shooting and teamwork. To achieve a fast shooting purpose, the guns for shooting generally come with an automatic bullet loading device, but the bullet storage device is usually protruded from the top of the gun, and thus the gun is not just bulky in size, but is also inconvenient to carry. Furthermore, the pressurized gas leaks from the bullet releasing hole easily since the bullet releasing hole is not shut completely during the shooting, and thus the pushing force of the bullet will be reduced and the shooting distance, precision, and speed will be affected adversely. Therefore, improvements are needed.

SUMMARY OF THE INVENTION

In view of shortcomings of the prior art, the inventor of the present invention based on years of experience in the air gun and paintball gun industry to conduct extensive researches and experiments, and finally invented an improved shooting device for air guns and paintball guns in accordance with the present invention.

Therefore, it is a primary objective of the present invention to provide an improved shooting device for air guns and paintball guns that comprises a gun barrel sheathed into a sliding base of a breech of a gun, a tension spring installed at the front end, a bullet supplying device installed at the rear end, an opener connected to the rear of the bullet supplying device, and a bullet supplying hole formed at the bottom of the bullet supplying device and interconnected with the bullet feeding hole of a handle type magazine. The gun barrel includes an elastic turning base pivotally connected thereon, a pushing groove formed at the rear edge of the turning base, a sliding surface formed at the bottom of the turning base, and the pushing groove and a pushing protrusion disposed at the top of a trigger are engaged, so that when the trigger is pulled, the pushing protrusion at the top of the trigger pushes the pushing groove of the turning base, such that the turning base drives the gun barrel to compress the tension spring and produce a forward displacement. In the meantime, the rear end of the gun barrel moves forward along the bullet supplying device to open the bullet supplying hole, such that the bullets will be supplied automatically from the bullet feeding hole of the cartridge magazine by the pushing force, until the pushing protrusion is separated from the pushing groove, and then the resilience of the tension spring drives the gun barrel to shift backward, and the rear end of the gun barrel will be loaded with a bullet and the bullet feeding hole will be shut, and the opener is pushed to open a valve. The high-pressure gas in a pressurized cylinder forces to shoot the bullet. The invention can reduce the volume of the automatic bullet loading device and avoid the leak of pressurized gas, and further improve the shooting force.

DETAILED DESCRIPTION OF THE PREFERRED EMBODIMENTS

Figure 1:
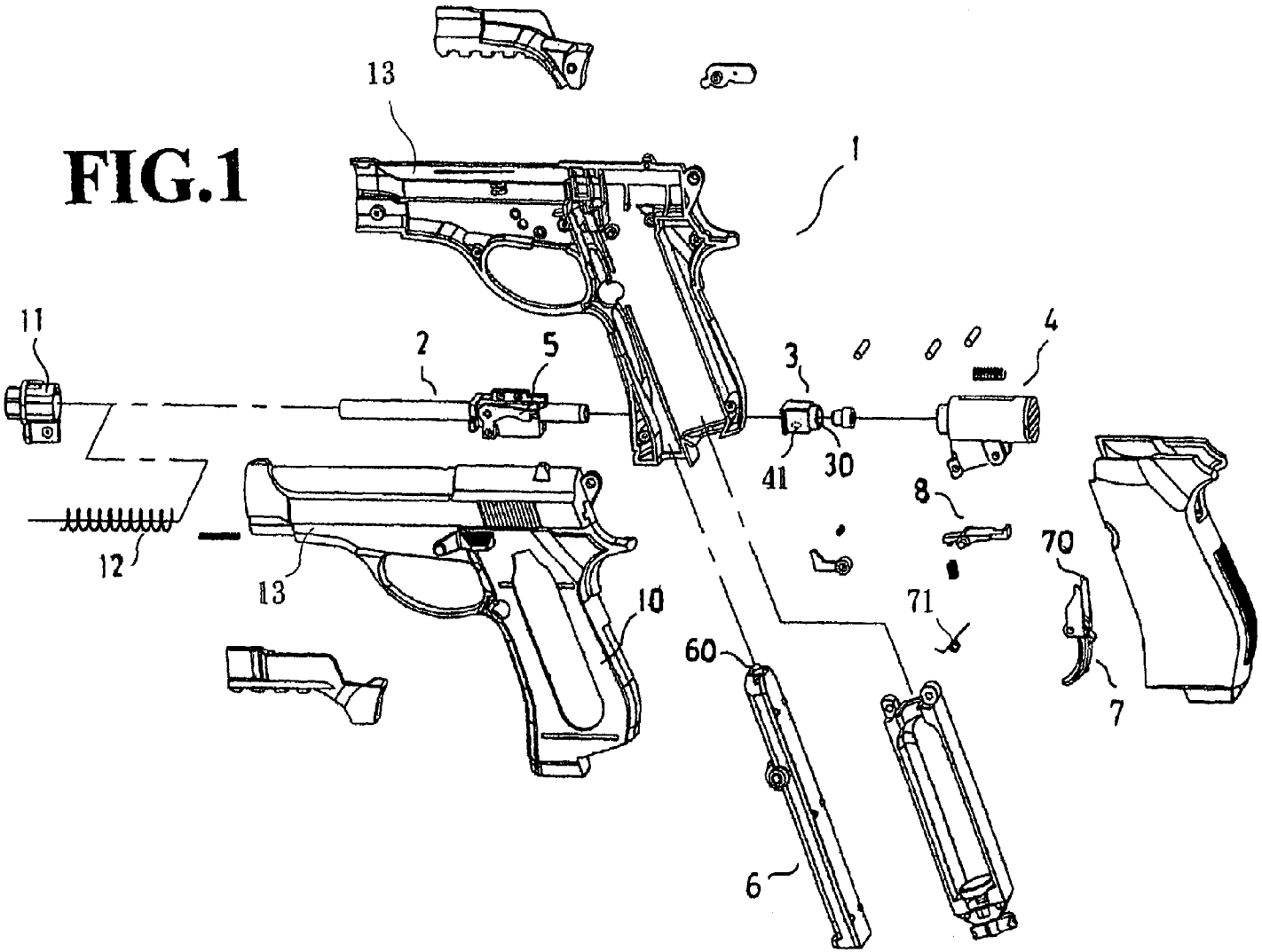
FIG. 1 is a perspective exploded view of a preferred embodiment of the invention.
Figure 2:
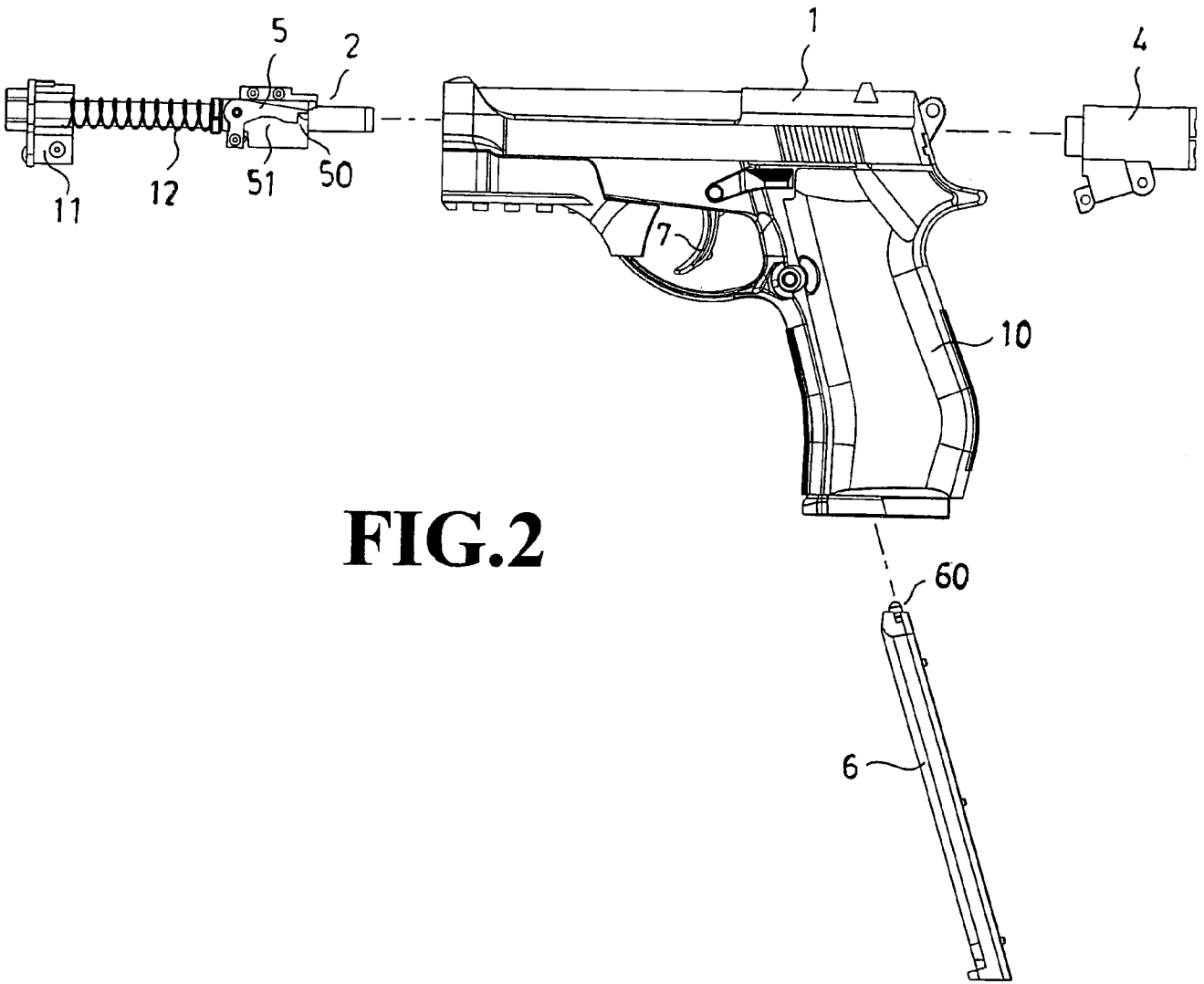
FIG. 2 is a schematic planar exploded view of a preferred embodiment of the invention.
Figure 3:
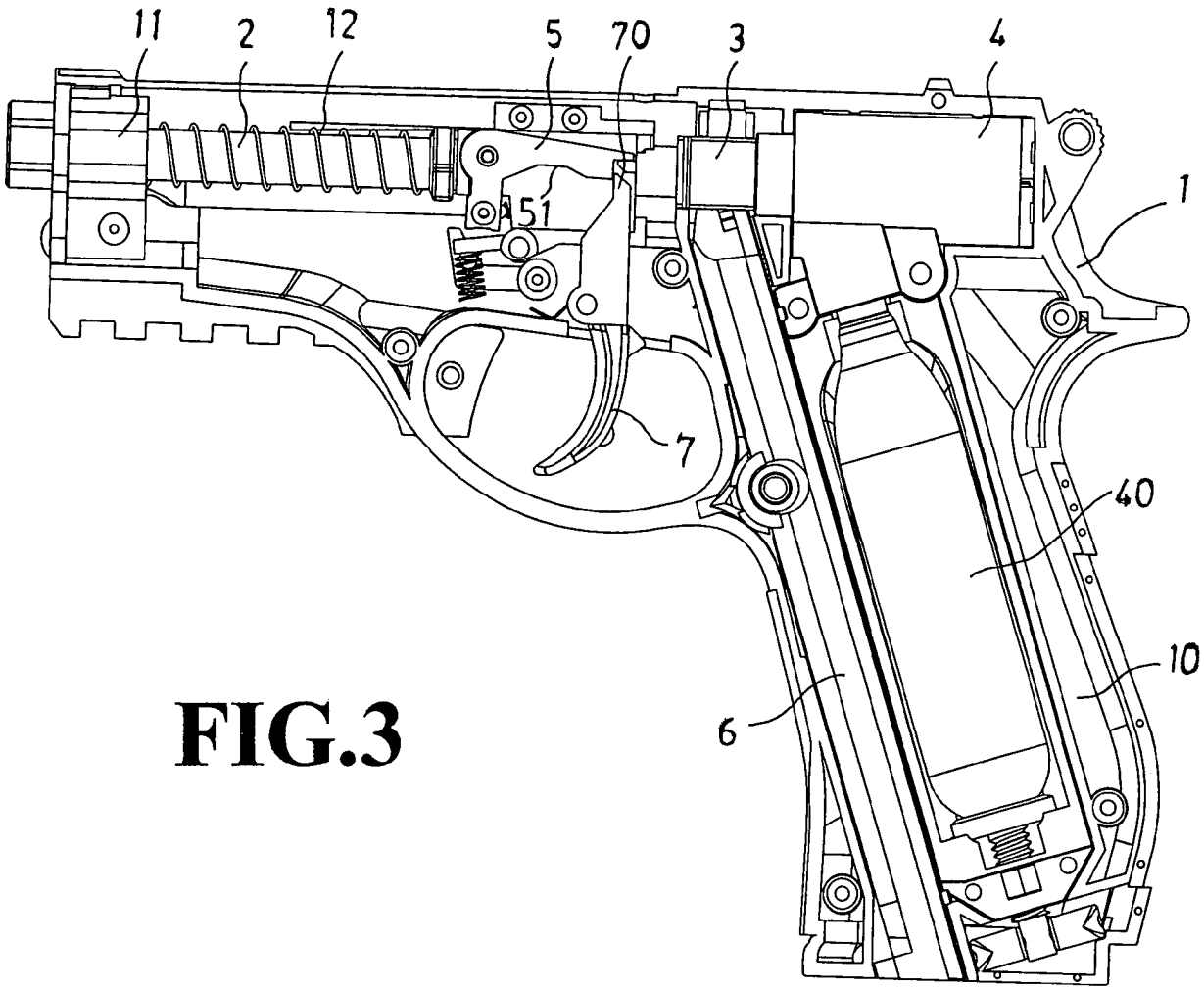
FIG. 3 is a lateral cross-sectional view of a preferred embodiment of the invention.
Figure 4:
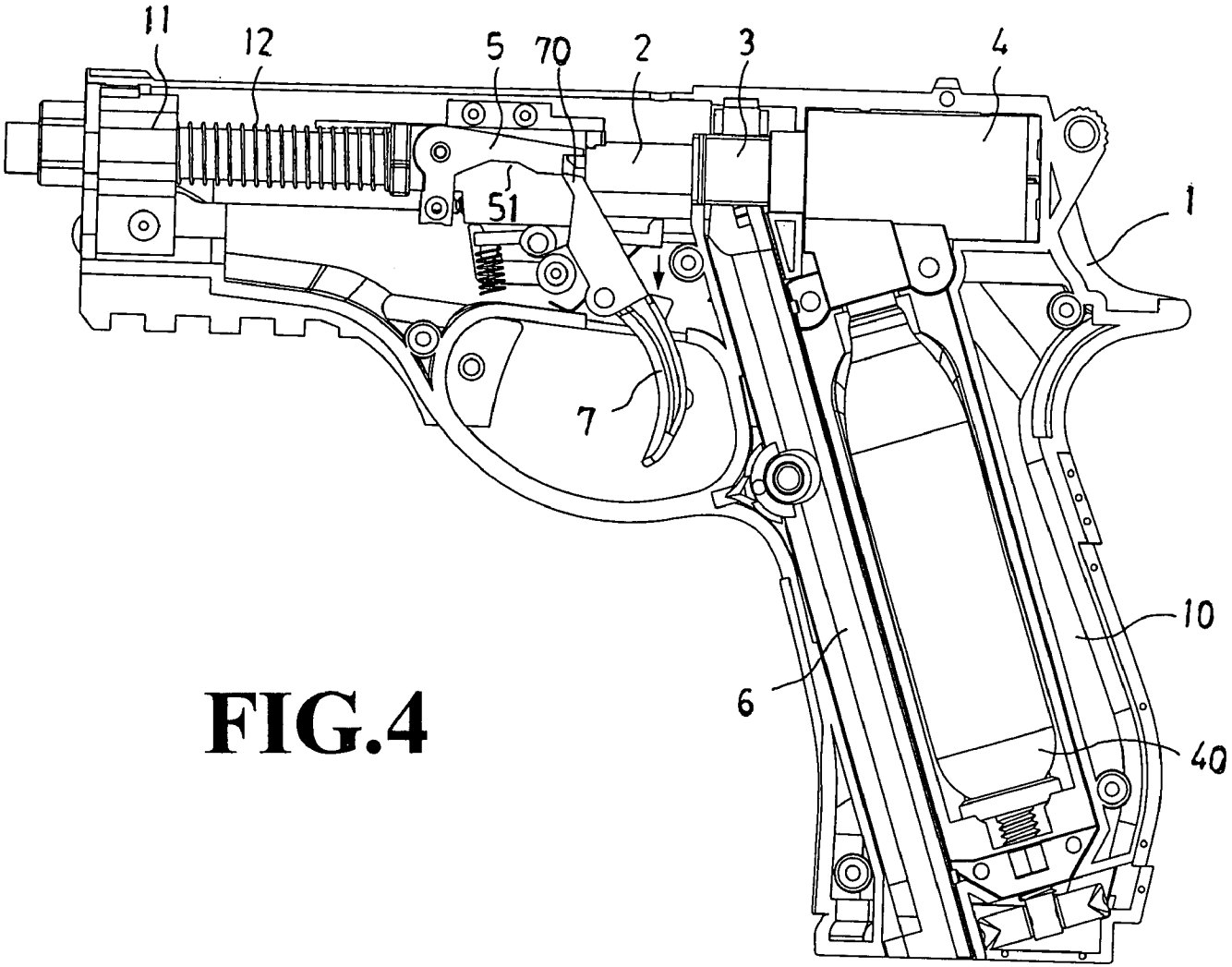
FIG. 4 is a lateral cross-sectional view of pulling a trigger as shown in FIG. 3.
Figure 5:
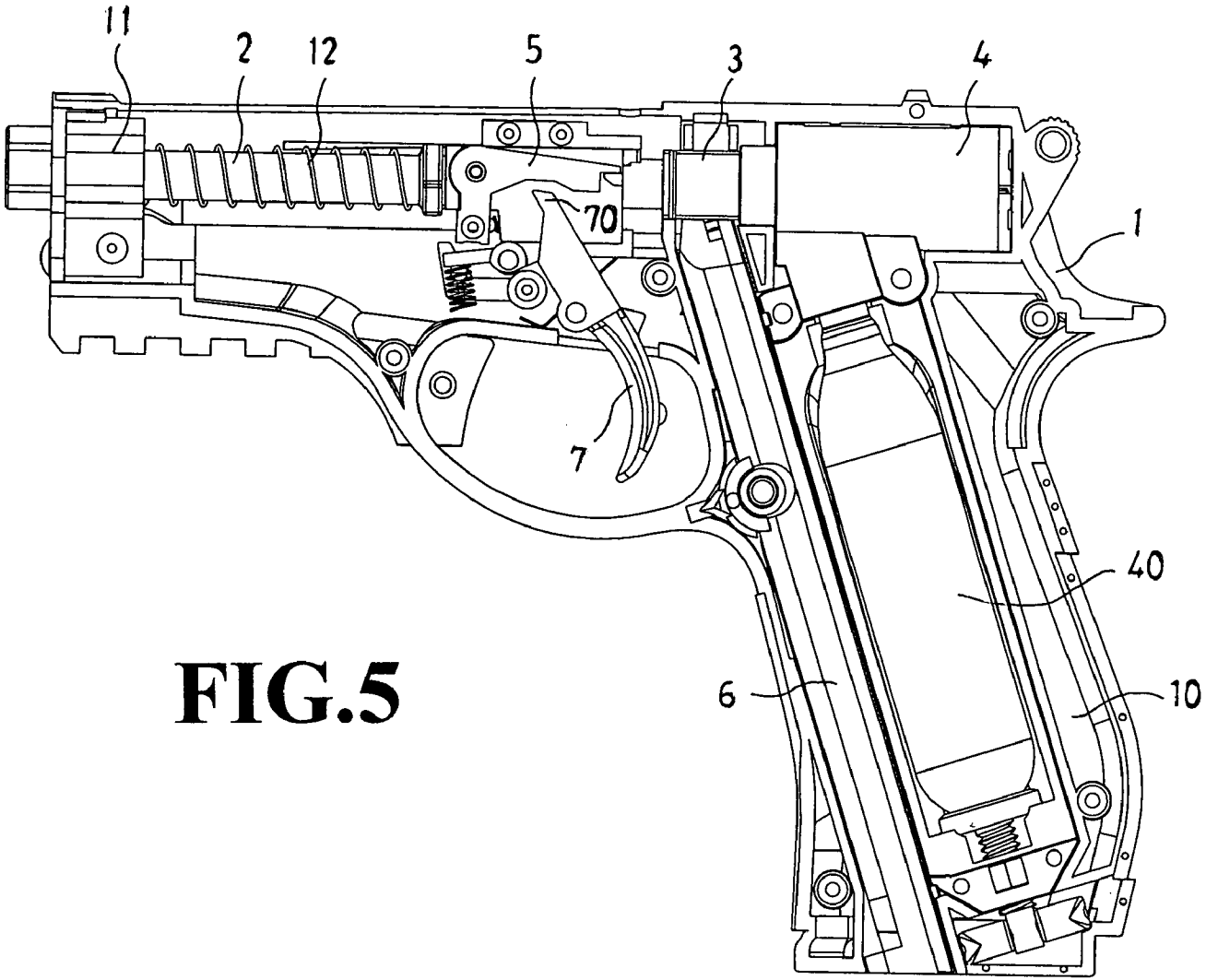
FIG. 5 is a lateral cross-sectional view of shooting as shown in FIG. 3.
Figure 6:
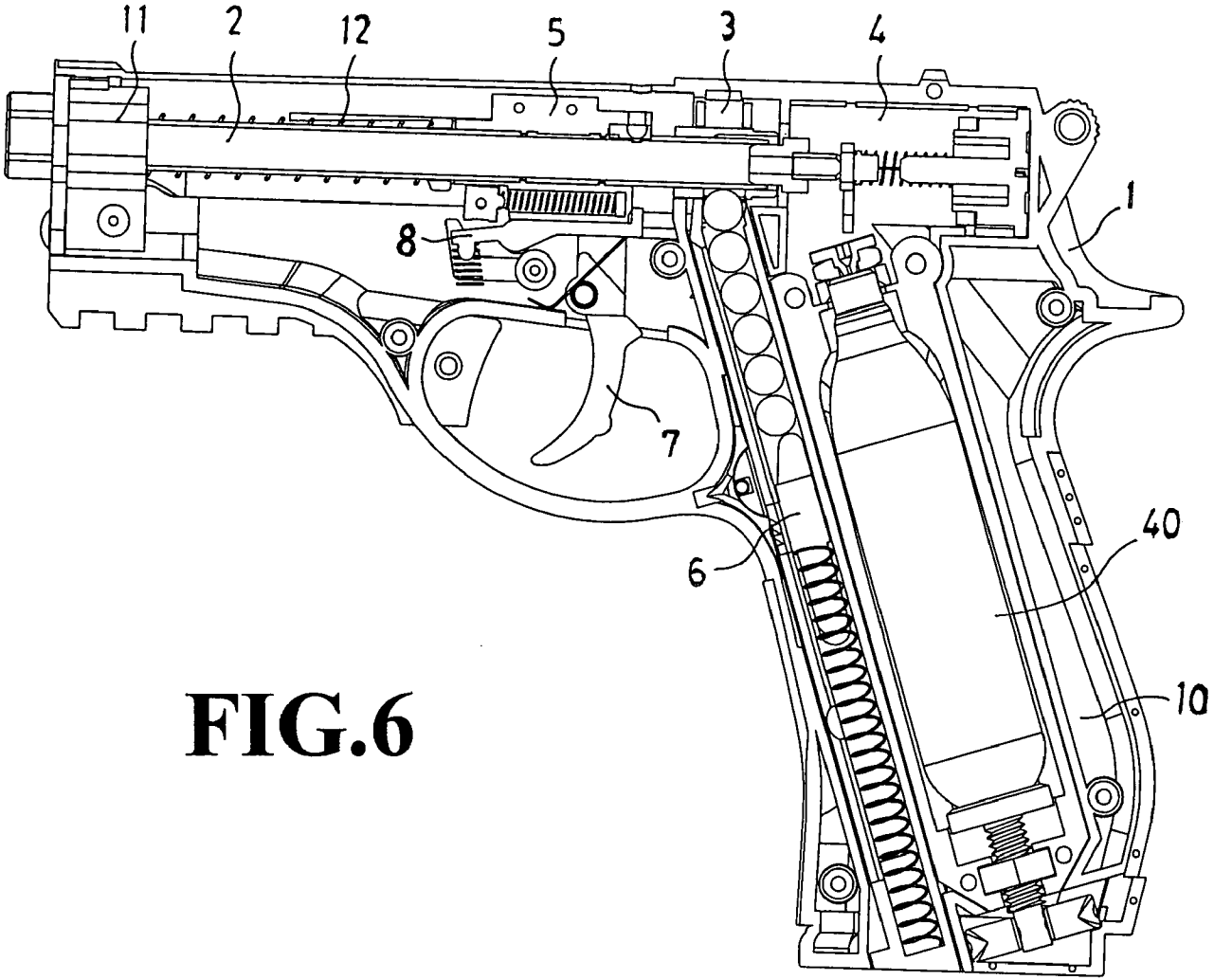
FIG. 6 is a lateral cross-sectional view of another preferred embodiment of the invention.
Figure 7:
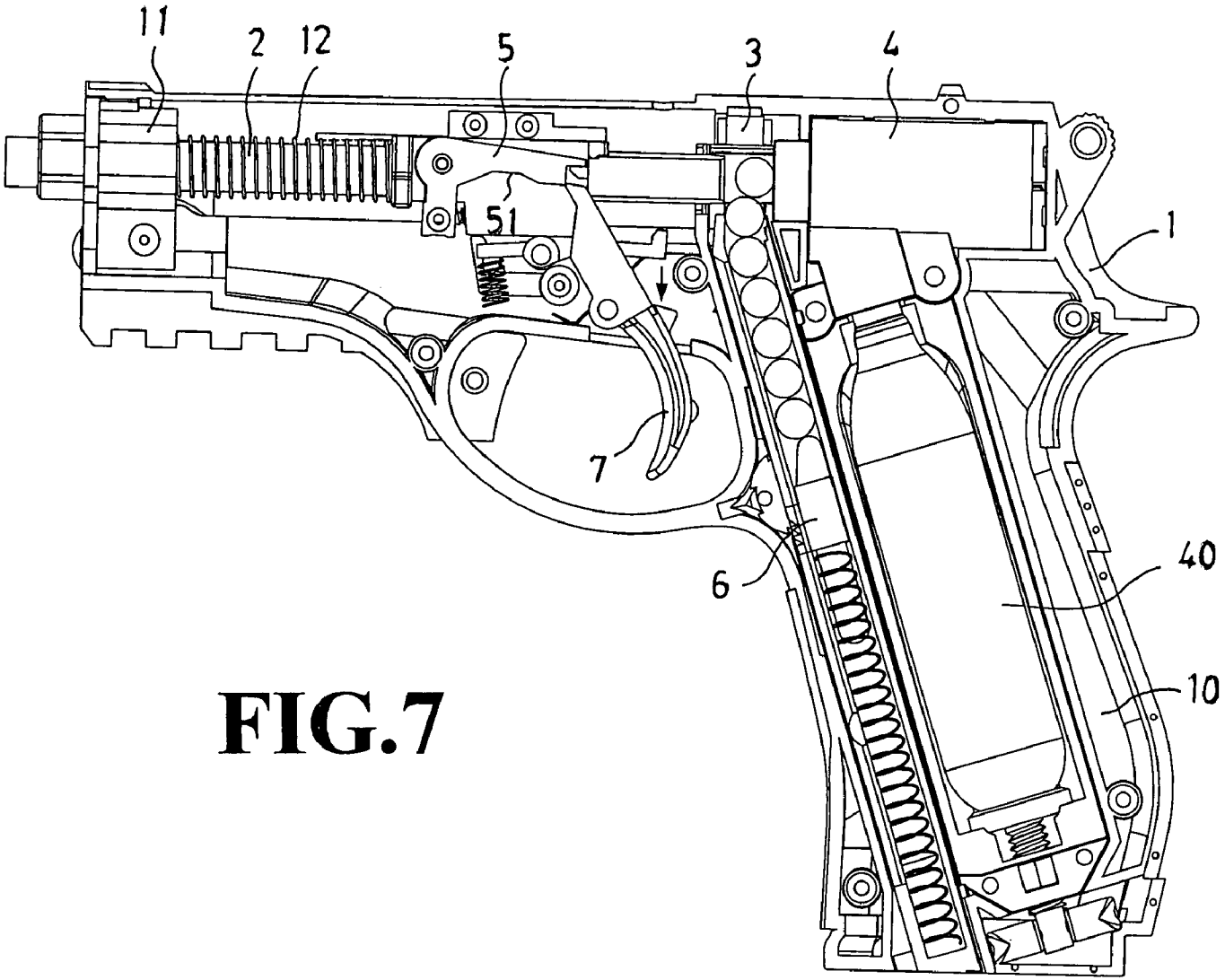
FIG. 7 is a lateral cross-sectional view of a ready-to-shoot status according to a preferred embodiment of the invention.
Figure 8:
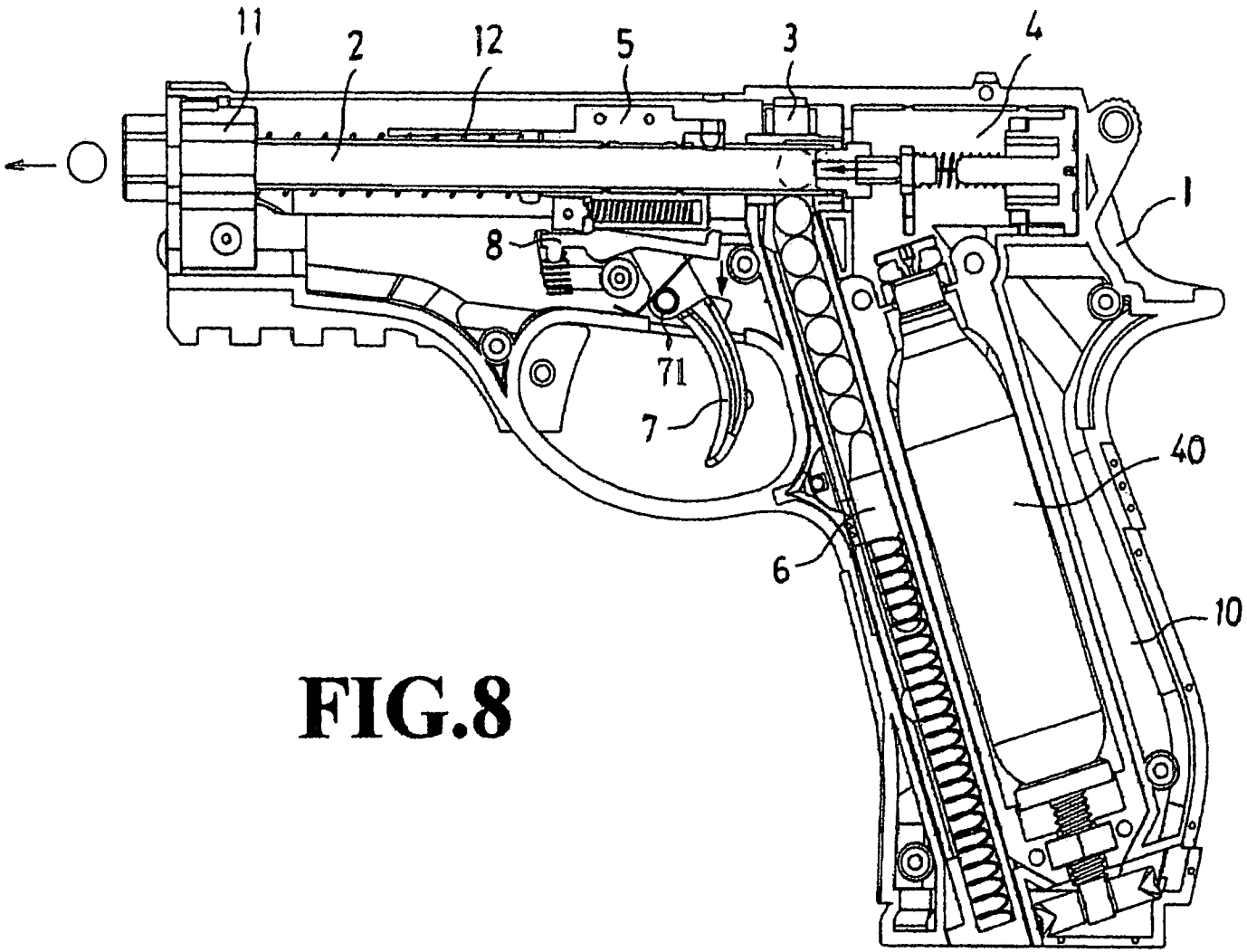
FIG. 8 is a lateral cross-sectional view of shooting a bullet as shown in the preferred embodiment as depicted in FIG. 7.

To make it easier for our examiner to understand the objective of the invention, its structure, innovative features, and performance, we use a preferred embodiment together with the attached drawings for the detailed description of the invention.

Referring to the figures, the invention comprises a gun breech 1, a gun barrel 2, a bullet supplying device 3, an opener 4, a turning base 5, a trigger 7, a safety latch 8, and a cartridge magazine 6; wherein the gun breech 1 is formed from two casing 13 forming a handle 10 provided for a user to grip with their palm, and the trigger 7 is provided for the user to pull with their finger; the two cases 13 forming a component casing provided for installing gun components, and the gun barrel 2 is a pipe for guiding pellets or paintballs and disposed in a sliding base 11 of the gun breech 1, and a tension spring 12 is installed at a front end and a through hole 30 of a bullet supplying device 3 is installed at a rear end, and the rear end of the bullet supplying device 3 is coupled to an opener 4 which includes a valve for selectively opening and shutting a pressurized cylinder 40, and the bullet supplying device 3 forms a bullet supplying hole 41 disposed under the through hole 30 of the bullet supplying device 3 and coupled to a bullet releasing hole 60 of the cartridge magazine 6 which is inserted into a handle 10 of the gun breech 1, and the gun barrel 2 further comprises an elastic turning base 5 pivotally coupled onto the gun barrel 2, a pushing groove 50 formed at a rear edge of the turning base 5, and a sliding surface 51 formed at the bottom of the turning base 5, and the pushing groove 50 is engaged with a pushing protrusion 70 disposed at the top of the trigger 7. Further, the elastic safety latch 8 is pivotally coupled to a side of the gun barrel 2 in the gun breech 1 and pressed by the trigger 7, so as to elastically push to produce a synchronous displacement with the trigger 7 to latch the gun barrel and prevent the gun barrel from moving backward.

In a practical application, a user inserts the cartridge magazine 6 into the position of the handle 10 of the gun breech 1 after shooting, and then secures the pressurized cylinder 40. The user holds the handle 10 by a palm, and aims the gun at a target. If the trigger 7 is pulled by a finger and the trigger 7 is turned, then the pushing protrusion 70 at the top pushes the pushing groove 50 of the turning base 5, so that the turning base 5 drives the gun barrel 2 to compress the tension spring 12 forward to produce a forward displacement. In the meantime, the rear end of the gun barrel 2 also moves forward along the through hole 30 of the cartridge magazine 6, and the bullet supplying hole 41 is opened, and a bullet will be pushed elastically upward from the bullet releasing hole of the cartridge magazine 6 to produce an automatic bullet feed action, until the pushing protrusion 60 is slid off from the tip of the pushing groove 50. The gun barrel 2 will be moved backward by the resilience of the tension spring 12, and the rear end of the gun barrel 2 will be loaded with a bullet and the bullet supplying hole will be shut. The opener 4 at the rear end is pushed to open a valve, and the high-pressure gas in the pressurized cylinder will force to shoot the bullet. In the meantime, the trigger 7 will be turned in an opposite direction by the resilience of the spring 71 to push the pushing protrusion 70 from the sliding surface 51 at the bottom of the turning base 5 into the pushing groove 50, so as to return to the original status and get ready for the next shooting. Since the cartridge magazine 6 feeds bullets from its bottom, the cartridge magazine 6 can be stored into the handle 10, so as to achieve the effect of reducing the volume of the protruded bullet supplying device to facilitate the carrying of the gun. This invention also prevents the leak of the pressurized gas during a shooting, and thus improving the shooting force, increasing the shooting distance, and enhancing the precision and shooting speed. If the trigger 7 is pulled, and the pushing protrusion 70 still remains at the tip of the pushing groove 50, and the gun barrel 2 is struck from the front, then the safety latch 8 resumes its position to latch the gun barrel 2, since the trigger 7 is turned in an opposite direction. Therefore, the gun barrel is prevented from moving backward or striking the opener to trigger a shot, and thus achieving the safety effect.

In summation of the above description, the present invention can reduce the size of the bullet supplying device to facilitate the carrying of the gun and prevent the leak of the pressurized gas to improve the shooting force, increasing the shooting distance, and enhancing the accuracy and shooting speed. Therefore the invention herein enhances the performance than the conventional structure and further complies with the patent application requirements.

While the invention has been described by means of specific embodiments, numerous modifications and variations could be made thereto by those skilled in the art without departing from the scope and spirit of the invention set forth in the claims.

What is claimed is:

1. An improved shooting device for air guns and paintball guns, comprising: a gun breech, a gun barrel, a bullet supplying device, an opener, a turning base, a trigger, and a cartridge magazine; wherein said gun breech comprises two cases forming a handle provided for a user to grip by a palm, and said trigger is provided for said user to pull by a finger, said cases forming a component casing for installing gun components, and said gun barrel is a pipe for guiding pellets or paintballs and disposed in a sliding base of said two cases, and a tension spring is installed at a front end and a through hole of a bullet supplying device is installed at a rear end, and the rear end of said bullet supplying device is coupled to an opener which includes a valve for selectively opening and shutting a pressurized cylinder, and said bullet supplying device forms a bullet supplying hole disposed under said through hole of said bullet supplying device and coupled to a bullet releasing hole of a cartridge magazine which is inserted into said handle wherein said turning base is pivotally coupled onto said gun barrel, a pushing groove formed at a rear edge of said turning base, and a sliding surface formed at the bottom of said turning base, and said pushing groove is engaged with a pushing protrusion disposed at the top of said trigger, such that after said trigger is pulled and said turning base drives the rear end of said gun barrel to open said bullet supplying hole of said bullet supplying device, said protrusion is pushed and slid off from the tip of said pushing groove.

2. The improved shooting device for air guns and paintball guns of claim 1, wherein an elastic safety latch is disposed at a side of said gun barrel and pressed by said trigger for elastically pushing said trigger to produce a synchronous displacement for latching said gun barrel so as to prevent said gun barrel from moving backward.

* * * * *